US008167035B2

(12) United States Patent
Whitelaw

(10) Patent No.: US 8,167,035 B2
(45) Date of Patent: May 1, 2012

(54) METHOD OF FORMING DOWNHOLE APPARATUS, DOWNHOLE APPARATUS AND CENTRALIZER COMPRISING THE SAME

(75) Inventor: Calum Whitelaw, Aberdeenshire (GB)

(73) Assignee: PolyOil Limited (GB)

( * ) Notice: Subject to any disclaimer, the term of this patent is extended or adjusted under 35 U.S.C. 154(b) by 304 days.

(21) Appl. No.: 12/446,351

(22) PCT Filed: Oct. 31, 2007

(86) PCT No.: PCT/GB2007/004144

§ 371 (c)(1),
(2), (4) Date: Jun. 22, 2009

(87) PCT Pub. No.: WO2008/053203

PCT Pub. Date: May 8, 2008

(65) Prior Publication Data

US 2010/0059218 A1 Mar. 11, 2010

(30) Foreign Application Priority Data

Nov. 3, 2006 (GB) ..... 0621892.9

(51) Int. Cl.
*E21B 17/10* (2006.01)
*B29C 45/14* (2006.01)

(52) U.S. Cl. ..... 166/241.7; 166/241.6; 264/257; 264/259; 264/271.1

(58) Field of Classification Search ..... 166/241.6, 166/241.7, 241.4, 241.1, 87, 187; 264/257, 264/259, 267, 271.1
See application file for complete search history.

(56) References Cited

U.S. PATENT DOCUMENTS

| | | | | |
|---|---|---|---|---|
| 2,943,009 | A * | 6/1960 | Mirsky et al. | 264/259 |
| 3,320,004 | A * | 5/1967 | Garrett | 175/325.5 |
| 3,666,013 | A * | 5/1972 | Saadeh | 166/241.1 |
| 4,241,789 | A * | 12/1980 | Grosch | 166/241.7 |
| 4,999,389 | A * | 3/1991 | Ariannejad | 523/440 |
| 6,666,267 | B1 * | 12/2003 | Charlton | 166/241.6 |
| 2003/0164236 | A1 * | 9/2003 | Thornton | 166/278 |

FOREIGN PATENT DOCUMENTS

| | | |
|---|---|---|
| GB | 2385342 | 8/2003 |
| WO | 02/02904 A | 1/2002 |

* cited by examiner

*Primary Examiner* — Shane Bomar
*Assistant Examiner* — Catherine Loikith
(74) *Attorney, Agent, or Firm* — DLA Piper LLP (US)

(57) ABSTRACT

The present invention relates to a method of forming downhole apparatus. The method comprises disposing a plastics material (26) on a reinforcing apparatus (24) to form a body (12) having a bore extending through the body. The reinforcing apparatus (24) provides reinforcement of the plastics material (26) and the thus formed body (12) is configured to provide, when in use, standoff between downhole components, with the reinforcing apparatus being configured to at least one of contract and expand.

17 Claims, 2 Drawing Sheets
(1 of 2 Drawing Sheet(s) Filed in Color)

METHOD OF FORMING DOWNHOLE APPARATUS, DOWNHOLE APPARATUS AND CENTRALIZER COMPRISING THE SAME

TECHNICAL FIELD

This disclosure relates to downhole apparatus configured to provide, in use, standoff between downhole components and methods of forming downhole apparatus.

BACKGROUND

It is known after drilling an oil or gas well to run tubing, known as casing, into the wellbore to act as a liner. The casing stabilizes the bore and prevents it from collapsing inwards. The casing is run into the newly formed bore from the surface, and the annular space between the casing and the bore is then filled with cement. The cement acts as a sealant and also to structurally support the casing.

It will be appreciated that before the casing is cemented in position it is important for the casing to be held substantially centrally in the bore. This allows a strong cement bond to be formed around the casing by ensuring that an even thickness is placed around the casing.

It is known to use centralizers to support the casing or liner away from the wellbore wall. Although there are several types of centralizer known in the art, one commonly used type is known as a solid centralizer. Solid centralizers are comprised of a hollow cylindrical body, often with a plurality of blades around the body. These blades are raised solid structures that extend longitudinally around the centralizer body and abut the wellbore wall to optimise stand off.

Centralizers are made from metal or plastics with each material offering its advantages and disadvantages. GB 2385342 describes a centralizer formed from both metal and plastics. The centralizer of GB 2385342 comprises a metal component that reinforces a main, plastics body of the centralizer. The metal component provides for reinforcement mainly in a direction radially of the centralizer bore.

I appreciated that the centralizer of GB 2385342 has shortcomings. More specifically, the centralizer of GB 2385342 can have a tendency, under certain circumstances, to break.

SUMMARY

I thus provide, according to a first aspect a method of forming downhole apparatus, the method comprising disposing a plastics material on a reinforcing apparatus to form a body having a bore extending through the body, the reinforcing apparatus providing reinforcement of the plastics material and the thus formed body being configured to provide, when in use, standoff between downhole components, in which the reinforcing apparatus is configured to at least one of contract and expand.

In forming known downhole apparatus, I discovered that the plastics material normally shrinks as it sets. Shrinkage of the plastics material when formed on a known reinforcing apparatus, which is formed, for example, of sheet metal that allows for no give, can result in stresses arising in the formed downhole apparatus. Having a reinforcing apparatus that is configured to at least one of contract and expand minimises the likelihood of stresses arising in the downhole apparatus as the plastics material sets. Thus, the reinforcing apparatus may be configured to at least one of expand and contract as the plastics material sets after the plastics material is disposed on the reinforcing apparatus.

Alternatively or in addition, the bore may extend longitudinally through the body and the reinforcing apparatus may be configured to contract and expand so as to provide at least one of contraction and expansion of the body in at least one of an axial direction and a radial direction.

Alternatively or in addition, the downhole apparatus may be configured for at least one of expansion and contraction by up to about 1 mm when in use.

Alternatively or in addition, the reinforcing apparatus may comprise a plurality of members movable in relation to each other to provide for at least one of contraction and expansion.

More specifically, adjacent ones of the plurality of members may be attached to each other.

More specifically, the plurality of members may form part of a homogeneous unitary body.

Alternatively or in addition, the reinforcing apparatus may comprise a mesh configured for at least one of contraction and expansion.

More specifically, the mesh may define a plurality of interstices of sufficient size to receive the plastics material when the plastics material is disposed on the reinforcing apparatus.

Alternatively or in addition, the mesh may be formed of a plurality of fibres.

Alternatively or in addition, the plurality of fibres may form an entangled mass.

Alternatively or in addition, the reinforcing apparatus may be formed at least in part of a woven structure.

More specifically, the woven structure may have a plain weave.

Alternatively or in addition, the method may comprise forming the reinforcing apparatus such that the reinforcing apparatus defines a shape of the body of downhole apparatus when formed.

More specifically, the method may comprise forming the reinforcing apparatus in a substantially cylindrical shape.

Alternatively or in addition, the method may comprise supporting the reinforcing apparatus in a mold and disposing the plastics material on the thus supported reinforcing apparatus.

Alternatively or in addition, the method may comprise disposing the plastics material around the reinforcing apparatus.

More specifically, the method may comprise supporting the reinforcing apparatus in the mold such that a surface of the reinforcing apparatus is exposed and disposing the plastics material on the exposed surface of the reinforcing apparatus such that the plastics material permeates through the reinforcing apparatus.

Alternatively or in addition, the plastics material may be disposed on the reinforcing apparatus such that when the downhole apparatus is formed the reinforcing apparatus is embedded in the plastics material.

Alternatively or in addition, disposing the plastics material may comprise gravity pouring the plastics material when in a liquid form.

Alternatively or in addition, the method may comprise the step of directly polymerising disposed liquid plastics material to form a solid.

Alternatively or in addition, the method may comprise forming the disposed plastics material into an annular shape by monomer casting.

Alternatively or in addition, the plastics material, when set, and the reinforcing apparatus may be attached to each other.

Alternatively or in addition, the reinforcing apparatus may comprise at least one of Kevlar®, a metal, such as steel, an expanded metal, glass fibers and carbon fibers.

Alternatively or in addition, the plastics material may comprise a thermoplastic plastics material.

More specifically, the plastics material may comprise a thermoplastic polyamide, such as Nylon®.

Alternatively or in addition, the plastics material may comprise at least one lactam, which polymerizes after being deposed on the reinforcing apparatus to form a thermoplastic polyamide.

More specifically, the method may comprise deposing at least one catalyst on the reinforcing apparatus.

Alternatively or in addition, method may comprise deposing at least one activator on the reinforcing apparatus.

The method may comprise forming the body from a plurality of molded segments each comprising plastics material disposed on reinforcing apparatus.

The method may further comprise cutting radially through the formed body to form at least two portions of body, each portion of body constituting downhole apparatus.

More specifically, a cut end of a portion of body may be machined to provide a desired profile of cut end.

The method may further comprise reducing the length of the body, e.g. by machining at least one end of the body. Thus, the body can be molded to a length greater than a desired length and machined to the desired length to thereby ensure that the reinforcing apparatus extends along the whole length of the body.

According to a second aspect, there is provided downhole apparatus configured to provide, in use, standoff between downhole components, the downhole apparatus comprising a body defining a bore, the body comprising a reinforcing apparatus and a plastics material disposed on the reinforcing apparatus, the reinforcing apparatus providing reinforcement of the plastics material, in which the reinforcing apparatus is configured for at least one of expansion and contraction.

More specifically, the bore may extend axially through the body and the reinforcing apparatus may be configured to at least one of expand and contract such that the body at least one of expands and contracts radially of the bore.

Alternatively or in addition, the downhole apparatus may be configured for at least one of expansion and contraction of the body when the downhole apparatus is in use.

More specifically, the downhole apparatus may be configured for at least one of expansion and contraction by up to about 1 mm.

Alternatively or in addition, the downhole apparatus may comprise a plurality of blades spaced apart around the body of the downhole apparatus.

More specifically, the plurality of blades may be attached to the body.

More specifically, the plurality of blades may be integrally formed with body.

Alternatively or in addition, the bore defined by the body may be configured to receive a first downhole component and an exterior surface of the body may be configured to engage with a second downhole component, whereby the downhole apparatus is configured to provide standoff between the first and second downhole components.

Further examples of the second aspect may comprise one or more features of the first aspect.

According to a third aspect, there is provided a centralizer comprising the downhole apparatus according to the second aspect.

More specifically the centralizer may be configured to be slipped onto a casing string or the like.

Alternatively or in addition, the downhole apparatus may be configured to be at least one of: run on a liner, run on a sand screen, run on a drill string and run on production tubing.

Examples of the third aspect may comprise one or more features of the first or second aspect.

According to a further aspect, there is provided downhole apparatus configured to provide, in use, standoff between downhole components, the downhole apparatus comprising a body defining a bore, the body comprising a reinforcing apparatus and a plastics material disposed on the reinforcing apparatus, the reinforcing apparatus providing reinforcement of the plastics material, in which the reinforcing apparatus comprises a plurality of members movable in relation to each other to provide for at least one of contraction and expansion of the reinforcing apparatus.

Examples of the further aspect may comprise one or more features of the first to third aspects.

BRIEF DESCRIPTION OF THE DRAWINGS

The patent or application file contains at least one drawing executed in color. Copies of the patent or patent application publication with color drawing(s) will be provided by the Office upon request and payment of the necessary fee.

Further features and advantages will become apparent from the following specific description, which is given by way of example only and with reference to the accompanying drawings, in which.

DETAILED DESCRIPTION

Figure 1:
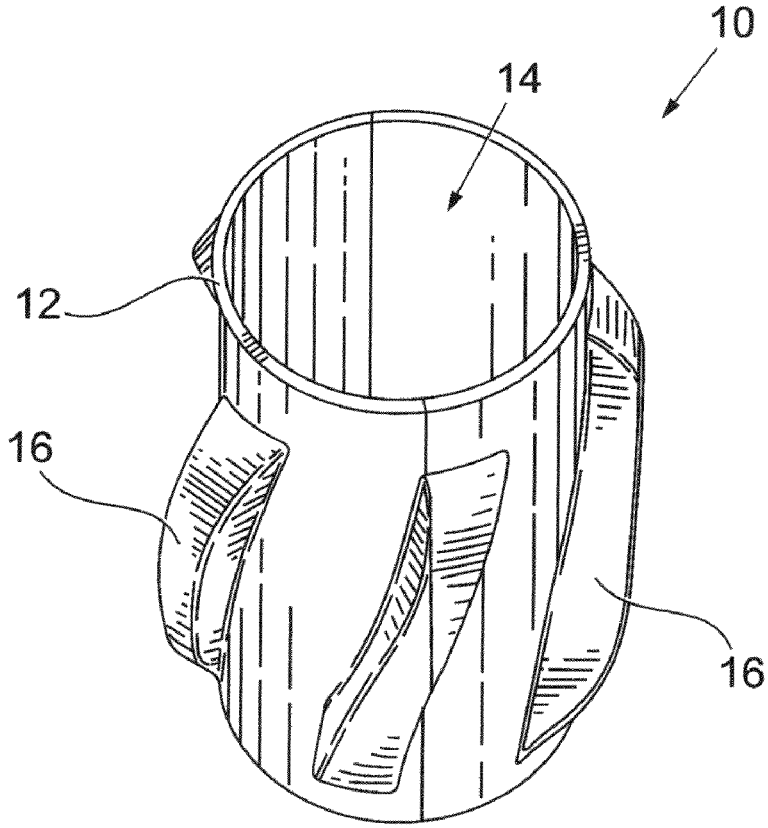
FIG. 1 shows a casing centralizer 10.

FIG. 1 shows a casing centralizer 10 (which constitutes downhole apparatus). The casing centralizer 10 comprises an annular body 12, which defines a longitudinally extending bore 14. A number of blades 16 are attached to and spaced apart around the external surface of the annular body 12. The blades 16 protrude from the surface and extend in a substantially longitudinal direction along the annular body. The blades are shaped such that they describe part of a helical path around a longitudinal axis of the annular body. The blades 16 determine the requisite clearance between the casing on which the centralizer 10 is located and a wellbore wall.

Figure 2:
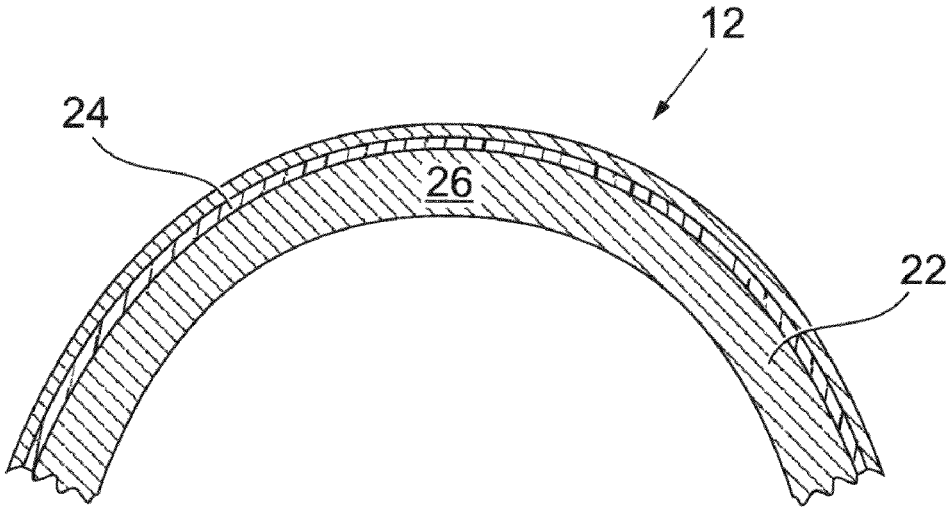
FIG. 2 shows a detailed sectional view through the body of the centralizer of FIG. 1.

FIG. 2 shows a detailed sectional view through the body 12 of the centralizer 10 of FIG. 1. As can be seen from FIG. 2, the body wall 22 comprises a mesh 24 (which constitutes a reinforcing apparatus) embedded within a plastics shell 26. The mesh 24 is closer to an exterior surface of the body 12 than an interior surface of the body.

Figure 3:
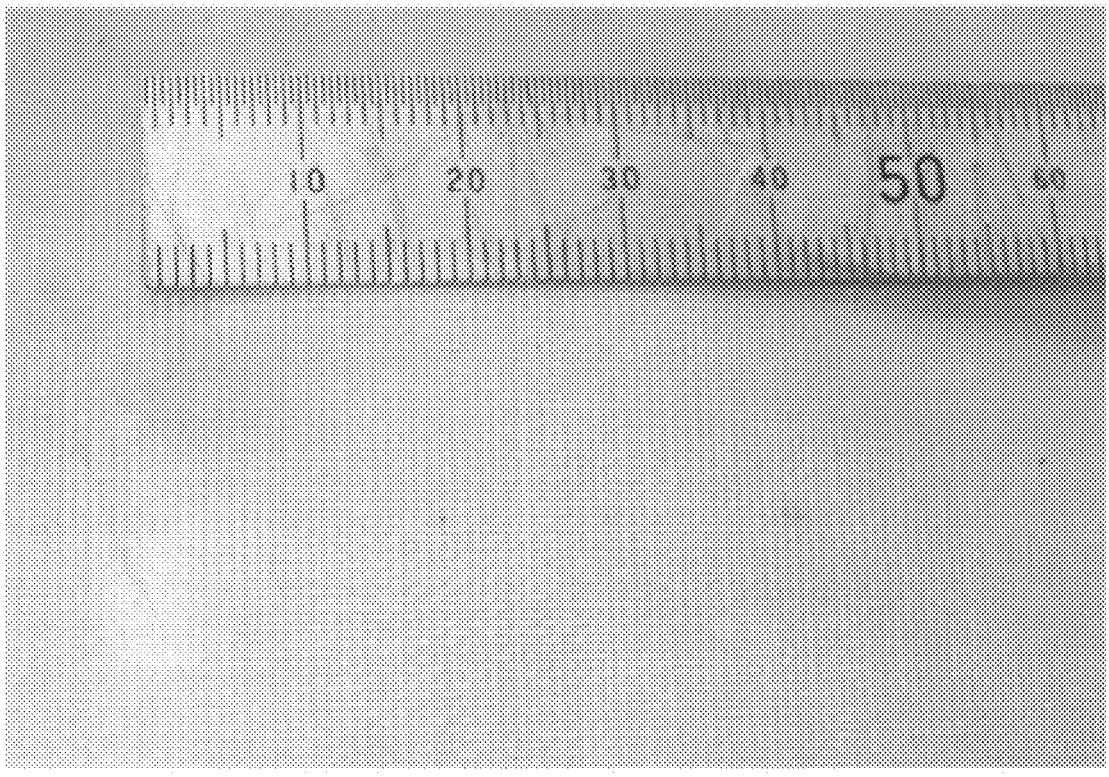
FIG. 3 is a picture of the exterior surface of the body of the centralizer of FIG. 1.

The plastics shell 26 and the blades 16 are formed of Nylon®. The mesh 24 is formed of woven glass fiber. FIG. 3 is a picture of the exterior surface of the body showing the woven glass fiber mesh embedded in the plastics shell and close to the surface of the plastics shell. The glass fiber mesh has a plain woven structure.

In an alternative structure, the mesh 24 is formed from a sheet of expanded metal, such as one of the Microgrid® expanded foils from Dexmet Corporation of Naugatuck, Conn. 06770, USA. The sheet of expanded metal is bent so as to form a cylinder before the plastics material is disposed on the expanded metal.

In further alternative structures, the mesh 24 is formed of one of: glass fiber matt containing entangled chopped fibers; woven cloth formed of carbon fibers; woven cloth formed of Kevlar® fibers; woven steel fibers; and the like.

The centralizer 10 is formed by placing the mesh 24 in a mold (not shown) and using a monomer casting approach to form the centralizer. More specifically, the monomer casting approach involves the use of three lactams, namely caprolactum, capryllactam and laurinlactum along with catalysts and activators, according to a known process, to form Nylon®, which is a polyamide material. The Nylon® produced by monomer casting has a greater crystalline structure, superior viscosity and greater molecular weight than can normally be obtained by injection or extrusion approaches. Thus, the Nylon® has an increased strength and wear resistance and is better suited to withstand the torque and drag that a centralizer is subject to in downhole environments. The lactams are gravity poured in a liquid form onto the mesh. Alternatively, the casting process may include a centrifugal casting step. The former approach provides cast Nylon® of greater density than the latter approach. The lactams permeate the mesh by penetrating the interstices in the mesh such that the mesh becomes embedded in the formed Nylon® material. Following polymerization, the thus formed body 12 of the centralizer is removed from the mold. Blades are formed as part of the molding process or can be attached to the exterior surface of the body in accordance with known practices. Alternatively, the body may be formed of two or more separately molded sections, with each section formed as described. The separate molded sections are bonded, joined or fastened together by known means.

Irrespective of the form of mesh 24 used the method of forming the centralizer is substantially the same. Where one of glass fiber matt containing entangled chopped fibers; woven cloth formed of carbon fibers; woven cloth formed of Kevlar® fibers; woven steel fibers; and the like is used, the mesh in question is formed in accordance with known practices.

As an alternative to the monomer casting approach described above, the centralizer is formed by reaction molding. The reaction molding approach involves, as with monomer casting, low pressure casting with polymerization in the mold using catalysts. Reaction molding normally provides for the formation of more complicated and defined sections than monomer casting.

In the approaches described above the centralizer is molded to its final length either as a unitary body or is formed as a body comprising two or more separately molded sections. In an alternative approach, the centralizer is molded to a length greater than its final length and then machined back to its final length. In this approach the centralizer is machined back to the ends of the reinforcing apparatus, such that the reinforcing apparatus extends along the whole length of the centralizer. The material and structure of the reinforcing apparatus is selected such that it is readily machined. This makes it easier to provide for reinforcing apparatus that extends along the whole length of the centralizer.

In a further alternative approach, two or more centralizers are formed by molding a unitary body, which is radially cut to form individual centralizers. Each cut end of the thus formed individual centralizers is machined to form an appropriately finished profile. The material and structure of the reinforcing apparatus is selected such that it can be readily machined. This approach makes it easier to guarantee that the reinforcing apparatus extends along the entire centralizer body and provides for a more efficient casting process. This approach offers the additional benefit of manufacturing flexibility; the unit length may be determined to suit a specific application. This can be particularly useful in sandscreen applications, for which axial room adjacent the sandscreen joint is often limited.

In use, an inner surface of the annular body 12 of the centralizer 10 abuts an outer surface of a casing. Depending on the conditions of use, the centralizer 10 may be able to rotate, or may remain stationary relative to the casing.

Although the above-described structures relate primarily to a casing centralizer, it will be appreciated that the above principles also apply to downhole devices for running on a drill string. For example, the described centralizer can be used to locate a tool within a liner, thereby reducing the drag between the tool and the liner casing. The low-friction characteristics of the device make it ideal for this purpose. In addition, the centralizer may be used on the outside of a liner, or could be applied to sand screens.

A further advantage resides in the use of Nylon® in the centralizer. More specifically, the natural heat-insulating properties of the Nylon® enable the well fluids to be maintained at higher temperatures. This has positive benefits in certain field developments where there can be problems with the formation of waxes or viscous crudes, which slow down or block production. Such problems arise from solid formation on cooling and/or the viscous drag created by an increase in fluid viscosity due to cooling nearer the surface. A centralizer could be run on the outside of the production tubulars over the entire length of the tubing. Alternatively, where the tubular suffers from chilling in certain well locations, the centralizer could be selectively run. For example, where the production tubular traverses the area inside a marine riser, the centralizer may be run over the upper section only.

I provide a downhole apparatus with increased hoop strength, a reduced likelihood of the apparatus swaging over a stop, collar or joint that abuts the apparatus. The downhole apparatus is reinforced to provide greater resistance to impacts and sideloads. The downhole apparatus can also maintain its mechanical properties at elevated wellbore temperatures. The reinforcing apparatus can be formed by a variety of manufacturing processes.

The invention claimed is:

1. A method of forming downhole apparatus comprising:

disposing a plastics material on a reinforcing apparatus to form a body having a bore extending through the body, the reinforcing apparatus providing reinforcement of the plastics material and the formed body being configured to provide, when in use, standoff between downhole components, in which the reinforcing apparatus is configured to at least one of contract and expand to minimize likelihood of stresses arising in the downhole apparatus as the plastics material sets;

supporting the reinforcing apparatus in a mold such that a surface of the reinforcing apparatus is exposed; and disposing the plastics material on the exposed surface of the reinforcing apparatus such that the plastics material permeates the reinforcing apparatus.

2. The method according to claim 1, in which the bore extends longitudinally through the body and the reinforcing apparatus is configured to at least one of contract and expand and provide at least one of contraction and expansion of the body in at least one of an axial direction and a radial direction.

3. The method according to claim 1, in which the reinforcing apparatus comprises a plurality of members movable in relation to each other to provide for at least one of contraction and expansion.

4. The method according to claim 3, in which adjacent ones of the plurality of members are attached to each other.

5. The method according to claim 1, in which the reinforcing apparatus comprises a mesh configured for at least one of contraction and expansion.

6. The method according to claim 5, in which the mesh defines a plurality of interstices of sufficient size to receive the plastics material when the plastics material is disposed on the reinforcing apparatus.

7. The method according to claim 5, in which the mesh is formed of a plurality of fibers.

8. The method according to claim 7, in which the plurality of fibers form an entangled mass.

9. The method according to claim 1, in which the reinforcing apparatus is formed at least in part of a woven structure.

10. The method according to claim 1, further comprising forming the reinforcing apparatus such that the reinforcing apparatus defines a shape of the body of downhole apparatus when formed.

11. The method according to claim 10, further comprising forming the reinforcing apparatus in a substantially cylindrical shape.

12. The method according to claim 1, in which disposing the plastics material comprises gravity pouring the plastics material when in a liquid form.

13. The method according to claim 1, in which the method comprises the step of directly polymerizing disposed liquid plastics material to form a solid.

14. The method according to claim 1, in which the method comprises forming the disposed plastics material into an annular shape by monomer casting.

15. The method according to claim 1, in which the plastics material, when set, and the reinforcing apparatus are attached to each other.

16. The method according to claim 1, in which the plastics material comprises a thermoplastic plastics material.

17. The method according to claim 1, in which the plastics material comprises at least one lactam, which polymerizes after being disposed on the reinforcing apparatus to form a thermoplastic polyamide.

* * * * *